United States Patent [19]

Padrun

[11] 4,110,951

[45] Sep. 5, 1978

[54] CONNECTING CLIP FOR JOINING CONCRETE REINFORCING BARS

[76] Inventor: John Padrun, 3154 Orange St., San Jose, Calif. 95127

[21] Appl. No.: 817,516

[22] Filed: Jul. 21, 1977

[51] Int. Cl.[2] ..... E04C 5/16

[52] U.S. Cl. ..... 52/686; 403/395; 403/399

[58] Field of Search ..... 403/395, 397, 398, 389, 403/399; 52/684, 685, 686, 687, 719

[56] References Cited

U.S. PATENT DOCUMENTS

| | | | |
|---|---|---|---|
| 3,255,565 | 6/1966 | Menzel | 52/687 X |
| 3,623,289 | 11/1971 | Lowery | 52/685 |
| 3,788,025 | 1/1974 | Holmes | 52/686 X |

FOREIGN PATENT DOCUMENTS

| | | | |
|---|---|---|---|
| 1,477,159 | 3/1967 | France | 52/684 |
| 2,111,243 | 5/1972 | Fed. Rep. of Germany | 52/685 |
| 1,040,368 | 8/1966 | United Kingdom | 52/686 |
| 1,073,746 | 6/1967 | United Kingdom | 52/719 |
| 1,459,662 | 12/1976 | United Kingdom | 52/684 |

*Primary Examiner*—Andrew V. Kundrat

*Attorney, Agent, or Firm*—Flehr, Hohbach, Test, Albritton & Herbert

[57] ABSTRACT

A clip for joining crossed reinforcing bars while holding each of the bars independently of the other includes a formed body of resilient plastic material of general U-shape configuration including confronting flange portions carried by an intermediate web portion at one end of the flanges. The interior surfaces of the flanges are formed to include arcuately relieved portions for yieldingly receiving and gripping one bar lying therein in a plane disposed between the planes of each of the flanges. The flanges also include aligned openings formed therethrough for receiving another bar disposed crosswise of the first bar. The flanges include passages leading into the aligned openings to permit the second bar to be lodged in the aligned openings independently of the first bar. Inner circumferential portions of the aligned openings are formed to include a thin flexible lip extending radially into the aligned openings for accommodating variations in sizes of reinforcing bars and frusto-conically shaped recesses adjacent the aligned openings are formed in the outer surfaces of the flanges for readily receiving reinforcing bars therein.

3 Claims, 4 Drawing Figures

FIG_1
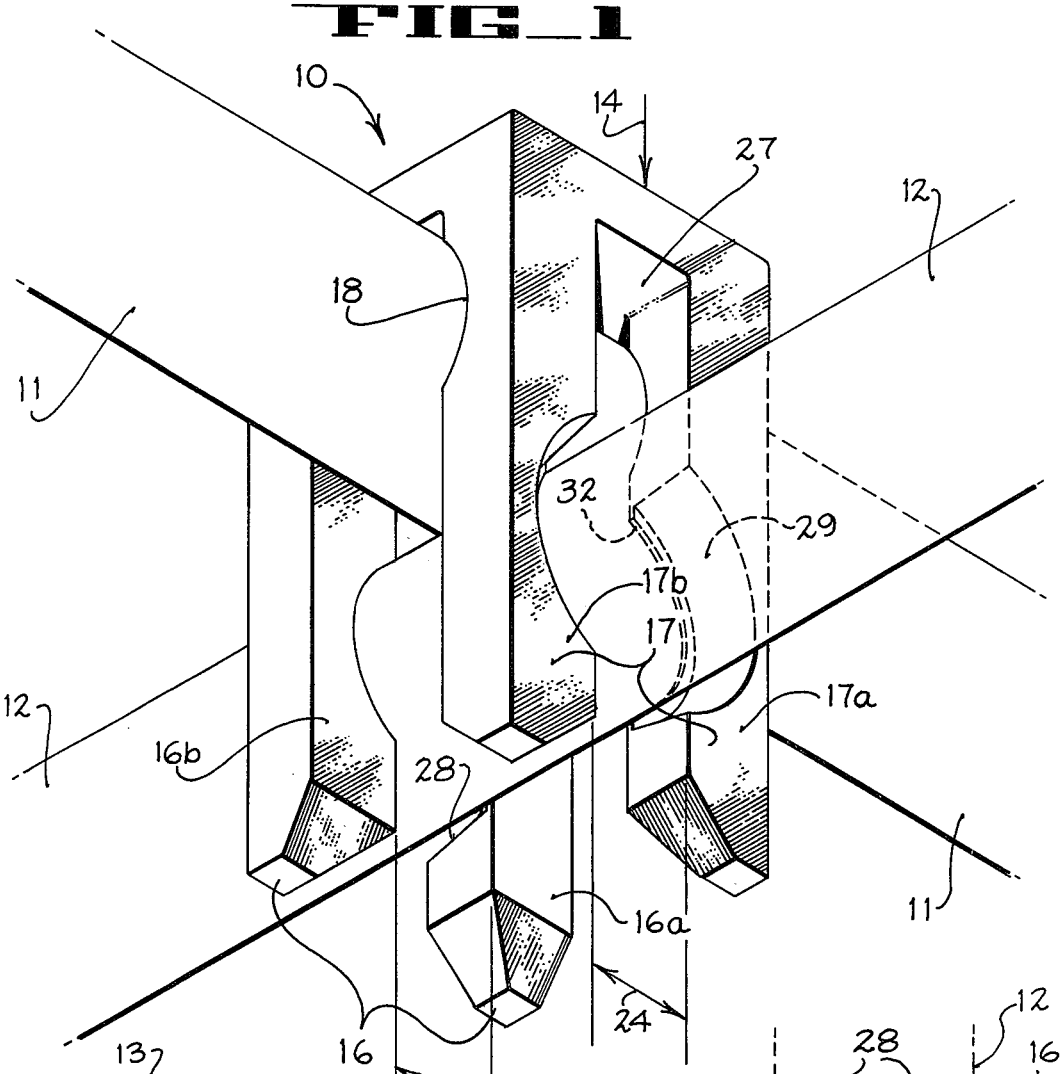
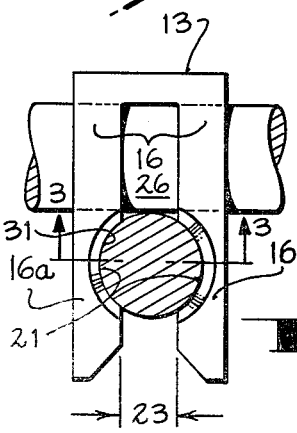
FIG_2
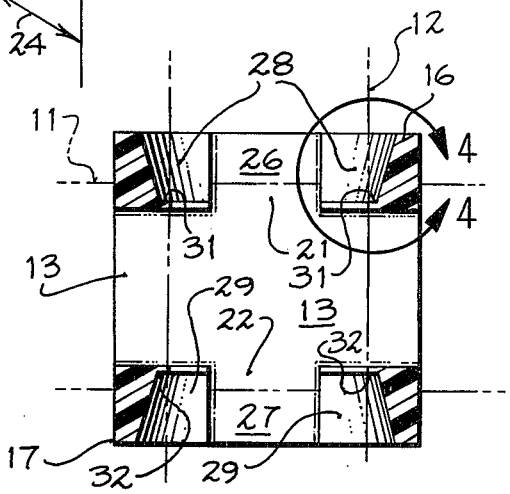
FIG_3
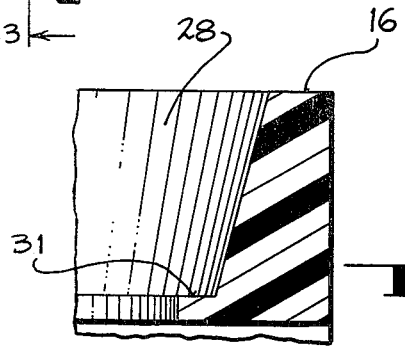
FIG_4

CONNECTING CLIP FOR JOINING CONCRETE REINFORCING BARS

BACKGROUND OF THE INVENTION

This invention pertains to means for reinforcement of concrete structures and more particularly to means for readily binding together intersecting reinforcing bars as employed for providing a reinforcing bar matrix for concrete reinforcement.

As is known, a matrix of reinforcing bars can be employed for strengthening concrete structures. In providing such a matrix it has, in the past, been typical to bind each pair of crossed bars at their points of intersection in the matrix by hand wiring.

While manual labor has been largely used for this purpose certain machines have also been employed for tying the bars together. However, to the extent that the wire tying machines may not be available for the preparation of matrix so constructed and in the interest of minimizing the time and labor involved in binding together each intersecting pair of bars there has been a need for an improved means for accomplishing same.

In addition to the above a hand wired matrix of bars for reinforcing concrete has been subject to the objection that where the ends of the wires are not clipped closely enough ends of the wire can be left to protrude through the surface of the concrete to form an objectionable snag on the surface thereof.

Accordingly, there has been a need for an improved means for connecting reinforcing bars at their points of intersection.

SUMMARY OF THE INVENTION AND OBJECTS

In general, there has been provided a clip for use in joining a pair of substantially cylindrical reinforcing bars of a type used for reinforcing concrete. The clip is substantially U-shaped with a pair of downwardly depending flanges coupled to a web portion whereby force can be applied to the web portion forcing the clip into engagement with a pair of intersecting reinforcing bars. The flanges are yieldingly separable to permit a first reinforcing bar to enter between the flanges and lie in a plane disposed therebetween. A pair of aligned openings are formed through the flanges for receiving another bar therein disposed crosswise of the first bar. The flanges include passages leading into the aligned openings to permit the second bar to be lodged in the aligned openings and seated therein independently of the first bar placed in the clip. The flanges include arcuately relieved portions surrounding the aligned openings on the outer surface of the flanges for yieldingly receiving therein and seating bar independently of the first bar.

BRIEF DESCRIPTION OF THE DRAWINGS

FIG. 1 shows a diagrammatic perspective view of the clip according to the invention disposed in engagement with a pair of crossed reinforcing bars;

FIG. 2 shows a side elevation view of the clip construction according to FIG. 1;

FIG. 3 shows a section view in plan looking upwardly in FIG. 2 and taken along the line 3—3 thereof;

FIG. 4 shows an enlarged detail view of that portion of FIG. 3 taken in the region 4—4.

DETAILED DESCRIPTION OF A PREFERRED EMBODIMENT

A clip 10 in the form of a molded plastic unit serves to join a pair of substantially cylindrical reinforcing bars 11, 12 of a type used in providing reinforcement to concrete.

A transversely extending web portion 13 serves to receive a downwardly applied force represented by the arrow 14 as the clip is being positioned onto the crossed bars 11, 12. In addition, web 13 carries a pair of downwardly depending sides or flanges 16, 17.

Means for independently seating bar 11 between flanges 16, 17 includes the arcuately relieved wall surfaces 18 forming a portion which yieldingly receives and grips bar 11 to hold it independently of bar 12.

Means for gripping the other bar 12 independently of bar 11 includes the aligned openings 21, 22 formed to extend transversely of the planes of flanges 16, 17 and through each of flanges 16, 17 respectively. Flanges 16, 17 each includes a passageway 23, 24 respectively leading into openings 21, 22 for receiving bar 12 to be moved therethrough until lodged in openings 21, 22. As thus arranged bar 12 is seated or gripped in openings 21, 22 independently of bar 11.

Means are provided for more readily assisting bar 12 to enter into openings 21, 22 and to yieldingly grip bar 12 as now to be described. Flanges 16, 17 are each subdivided into a pair of flange or jaw portions **16*a*, 16*b*, 17*a* and 17 *b* respectively formed by extending openings 23, 24 upwardly to the transversely extending web portion 13 so as to form the elongate slots 26, 27 on a diameter of each opening 21, 22. In this way flange or jaw portions 16*a*, 16*b*, 17*a* and 17*b* can be resiliently urged apart relying on the flexibility of web 13 as well as the flexibility of the material of each flange portion 16*a*, 16*b*, 17*a* and 17*b***.

Further, entry of bar 12 is assisted by the provision of portions of frustoconically shaped recesses 28, 29 disposed about openings 21, 22 on the outer surfaces of flanges 16, 17.

It has been observed that reinforcing bars of the kind described can vary in diameter and, accordingly, in order to accommodate variations in diameter of the bars of any given size as well as for accommodating a limited range of sizes the radially inner edge adjacent openings 21, 22 includes thin arcuate flexible lip portions 31, 32 extending radially into openings 21, 22 which flex for accommodating variations in size of reinforcing bars 12 disposed in openings 21, 22.

Thus, slots 26, 27 serve to subdivide each flange into a pair of portions lying in substantially a common plane while permitting each pair of flange portions **16*a*, 16*b*, 17*a* and 17*b* to be sufficiently spread apart in their own planes to permit a reinforcing bar to be moved into aligned openings 21, 22**.

As shown in FIG. 4 the radially inwardly protruding flexible lip portion 32 is sufficiently thin to permit flexing so as to form a seal along the side of a reinforcing bar 12 disposed within opening 22 and compensate for variations in the size of bar 12.

From the foregoing it will be readily evident that there has been provided an improved means for securing a pair of crossed reinforcing bars as used in reinforcing concrete, in which each is gripped by its own "snap fit" portion of the clip.

What is claimed is:

1. A clip for use in joining a pair of substantially cylindrical reinforcing bars of a type used in reinforcing concrete comprising a substantially U-shaped molded unit having a flexible web portion forming a pressure transmitting panel, opposed flanges carried by said web portion to depend downwardly therefrom, said flanges being yieldingly separable to permit one of said bars to enter and lie in a plane therebetween, the confronting surfaces of said flanges including arcuately relieved portions for yieldingly receiving and gripping said one bar therein independently of the other bar, aligned openings formed through said flanges for receiving the other bar therein disposed crosswise of said one bar, said flanges including passages leading into said aligned openings to permit the other bar to be disposed in said aligned openings and seated therein independently of said one bar, and portions of a frustoconically shaped recess formed in said flanges in the region surrounding said aligned openings for readily receiving a reinforcing bar in said openings.

2. A clip for use in joining a pair of substantially cylindrical reinforcing bars of a type used in reinforcing concrete comprising a substantially U-shaped molded unit having a flexible web portion forming a pressure transmitting panel, opposed flanges carried by said web portion to depend downwardly therefrom, said flanges being yieldingly separable to permit one of said bars to enter and lie in a plane therebetween, the confronting surfaces of said flanges including arcuately relieved portions for yieldingly receiving and gripping said one bar therein independently of the other bar, aligned openings formed through said flanges for receiving the other bar therein disposed crosswise of said one bar, said flanges including passages leading into said aligned openings to permit the other bar to be moved into said aligned openings and seated therein independently of said one bar, the radially inner edge of said aligned openings comprising a thin arcuate flexible lip portion extending radially into said aligned openings for accommodating variations in the sizes of reinforcing bars disposed in said aligned openings.

3. In a clip for use in joining a pair of substantially cylindrical reinforcing bars of a type used in reinforcing concrete comprising a substantially U-shaped molded unit having a flexible web portion forming a pressure transmitting panel, opposed flanges carried by said web portion to depend downwardly therefrom in spaced apart relation to allow a substantial body of concrete to be deposited therebetween, aligned openings formed through said flanges, and sufficiently open passages leading into said openings to permit a reinforcing bar to be forced therealong to be disposed into said openings crosswise of another reinforcing bar lying between and in a plane parallel to said flanges, the radially inner edge of said aligned openings being defined by a thin arcuate flexible lip portion extending radially into said openings for accommodating variations in the sizes of reinforcing bars disposed within said aligned openings.

* * * * *